US008789575B2

(12) United States Patent
Shih et al.

(10) Patent No.: US 8,789,575 B2
(45) Date of Patent: Jul. 29, 2014

(54) STRINGLESS BLINDS

(75) Inventors: Chin-Chang Shih, Changhua (TW); Yang-Hsin Shih, Changhua (TW)

(73) Assignees: Taiwan Bamboo Curtain Enterprise Co. Ltd., Changhua (TW); Chin-Chang Shih, Changhua (TW)

( * ) Notice: Subject to any disclaimer, the term of this patent is extended or adjusted under 35 U.S.C. 154(b) by 155 days.

(21) Appl. No.: 13/476,849

(22) Filed: May 21, 2012

(65) Prior Publication Data

US 2013/0240166 A1 Sep. 19, 2013

(30) Foreign Application Priority Data

Mar. 14, 2012 (TW) ..... 101204616 A

(51) Int. Cl.
*E06B 9/08* (2006.01)

(52) U.S. Cl.
USPC ..... 160/84.06; 160/84.05

(58) Field of Classification Search
USPC ..... 160/84.04, 84.05, 84.06, 84.03, 172 R
See application file for complete search history.

(56) References Cited

U.S. PATENT DOCUMENTS 6,024,154 A * 2/2000 Wang et al. ..... 160/170
6,095,222 A * 8/2000 Voss ..... 160/84.05
7,096,917 B2 * 8/2006 Ciuca et al. ..... 160/170
7,228,797 B1 * 6/2007 Hillman et al. ..... 100/170
7,984,745 B2 * 7/2011 Wen et al. ..... 160/170
8,245,756 B2 * 8/2012 Cheng et al. ..... 160/170
8,459,325 B2 * 6/2013 Faller et al. ..... 160/84.05
2002/0157796 A1 * 10/2002 Judkins ..... 160/84.04
2007/0125502 A1 * 6/2007 Liang ..... 160/84.05
2007/0267151 A1 * 11/2007 Faller et al. ..... 160/84.05
2011/0005690 A1 * 1/2011 Harding ..... 160/84.03
2012/0067527 A1 * 3/2012 Cheng ..... 160/84.02
2013/0255891 A1 * 10/2013 Shih et al. ..... 160/168.1 R

* cited by examiner

*Primary Examiner* — Katherine Mitchell
*Assistant Examiner* — Scott Denion
(74) *Attorney, Agent, or Firm* — Che-Yang Chen; Law Office of Michael Chen

(57) ABSTRACT

A stringless blind structure includes a mail rail, a secondary rail, a main blind body and a string body. The main rail, the secondary rail and the main blind body are connected and operated through the string body and a string, so the cost of the structure is lower and the it is more convenient and easier to assemble. Also, the string body winds around two connecting units, and is restricted by the string. When the main blind body expands or restores through the movement of the main rail and the secondary rail, the movement is restricted and controlled by the string to achieve the goal of stringless movement to reduce the noise when the blind moves and to further improve the life quality at home.

4 Claims, 9 Drawing Sheets

STRINGLESS BLINDS

FIELD OF THE INVENTION

The present invention relates to a blind structure, and more particularly to a stringless blind structure.

BACKGROUND OF THE INVENTION

Conventionally, a stringless blind structure includes a blind structure having an upper beam with a receiving slot, and the bottom of the receiving slot has a plurality of through holes for strings. Also, a string controller and a fixed base are disposed on both sides, and a moving base is disposed between the string controller and the fixed base. The bottom of the upper beam has a blind body and a lower beam, and a plurality of string holes are formed corresponding to the through holes on the upper beam. A plurality of guiding units are formed on the fixed base and moving base to achieve the goal of guiding when the string is pulled or released. A transmitting string is coupled with the string controller, and one end of the transmitting string and one side of the moving base have a block and a protruding block to engage with each other, so that the transmitting string can wind around the moving base and the fixed base and connect with each other. A user can simply applies force to the lower beam to change the status of the string on the moving base and control the transmitting string, so that the user can easily control the blind body to expand or restore.

However, conventional stringless blind structure is disadvantageous because there are too many components and it is not easy to assemble, so the cost to assemble the structure is high and it is difficult to maintain. Also, the expansion and restoration of the blind body is controlled by the moving base and string controller, so it generates noise when the moving base moves. Furthermore, the string controller generates noise as well when it pulls or release the transmitting string due to the interaction of inner rotor and spring. Therefore, there remains a need for a new and improved stringless blind structure to overcome the problems stated above.

SUMMARY OF THE INVENTION

The problem the present invention would like to solve is that conventional stringless blind structure is disadvantageous because there are too many components and it is not easy to assemble, so the cost to assemble the structure is high and it is difficult to maintain. Also, the expansion and restoration of the blind body is controlled by the moving base and string controller, so it generates noise when the moving base moves. Furthermore, the string controller generates noise as well when it pulls or release the transmitting string due to the interaction of inner rotor and spring.

To solve and overcome the problems stated above, the present invention provides a stringless blind structure including a main rail, a secondary rail, a main blind body and a string body. An open slot is horizontally formed at one side of the main rail, and a sliding rail is formed inside. A second open slot is horizontally formed at one side of the secondary rail, and a second sliding rail is formed inside. Inner space of the secondary rail is divided into a left side and a right side, and a corresponding restricting portion is formed therein. One end of a string is disposed around the restricting portion, and a connecting unit is coupled with the same end. The main blind body engages with the main rail and the secondary rail through an upper end and a lower end, and two through holes are formed through the upper portion to the lower portion of the main blind body. The string body winds several times between two connecting units and two ends thereof with identical length are cross, inserted into the through holes of the main blind body, and tied at the upper portion of the main blind body to form a secured positioning.

Comparing with the conventional arts, the present invention is advantageous because the main rail, the secondary rail and the main blind body are connected and operated through the string body and the string, so the cost of the structure is lower and the it is more convenient and easier to assemble. Also, the string body winds around two connecting units, and is restricted by the string. When the main blind body expands or restores through the movement of the main rail and the secondary rail, the movement is restricted and controlled by the string to achieve the goal of stringless movement to reduce the noise when the blind moves and to further improve the life quality at home.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
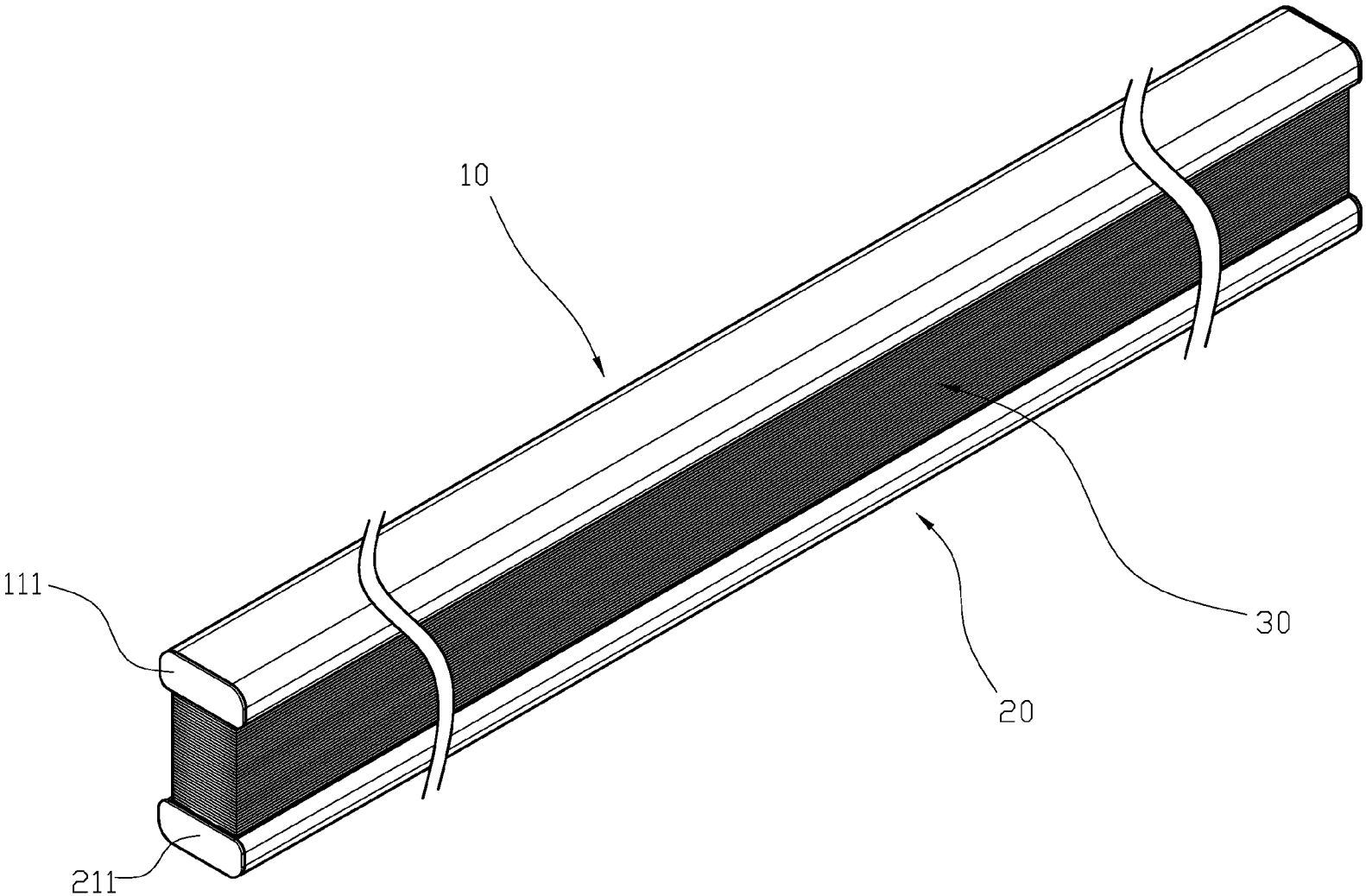
FIG. 1 illustrates a three-dimensional view in the present invention.
Figure 2:
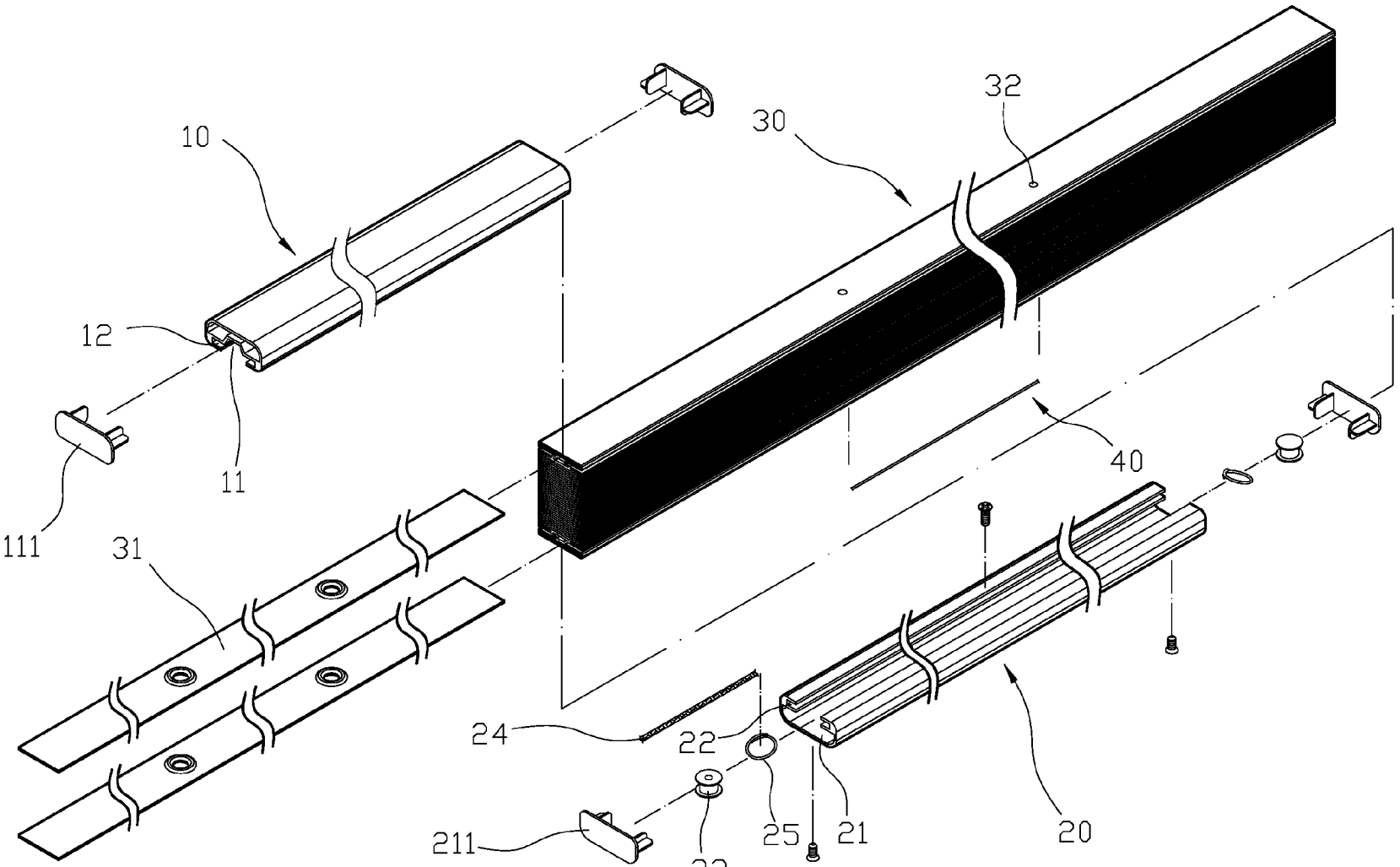
FIG. 2 illustrates an exploded view in the present invention.
Figure 3:
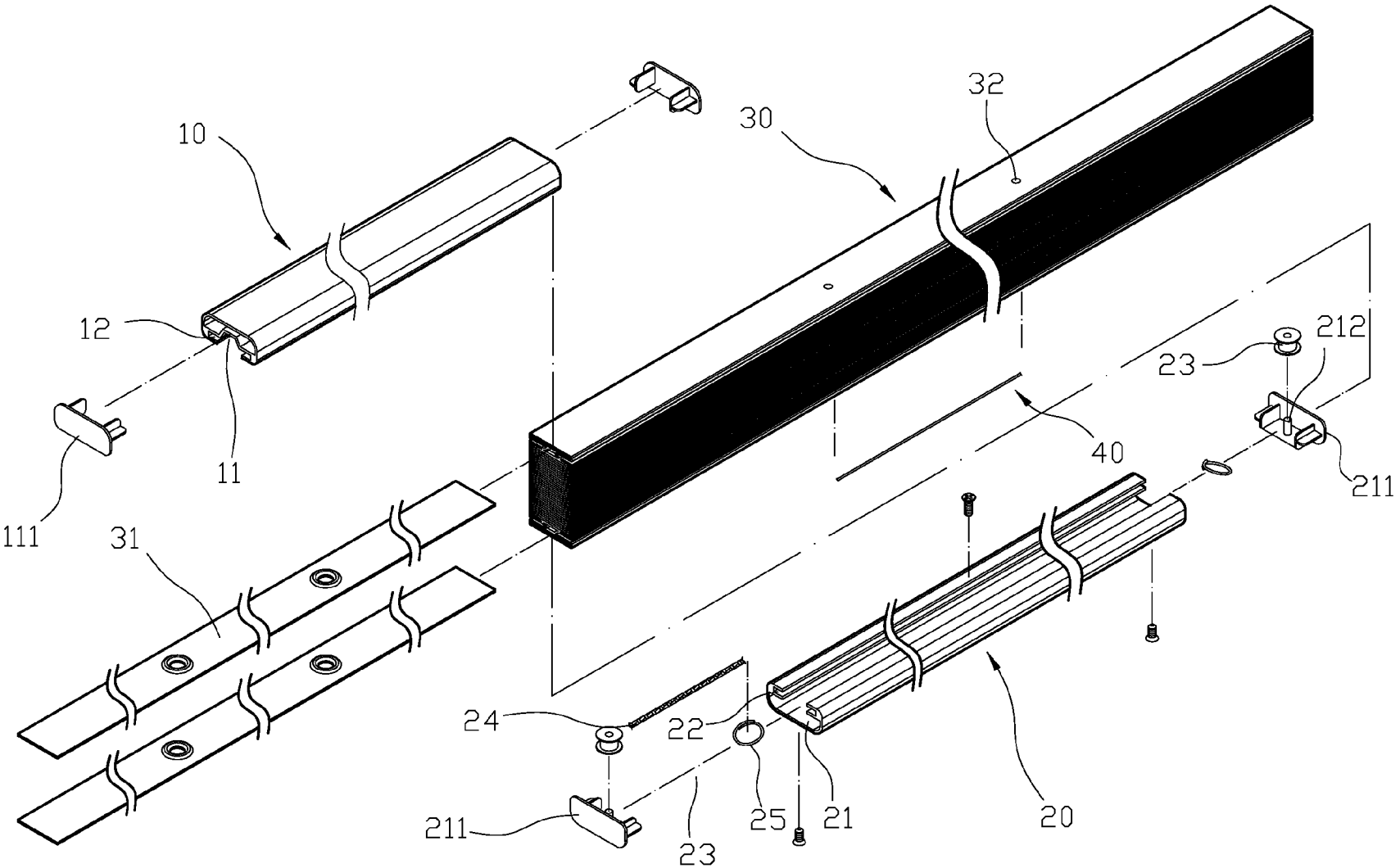
FIG. 3 illustrates an exploded view of another embodiment in the present invention.
Figure 4:
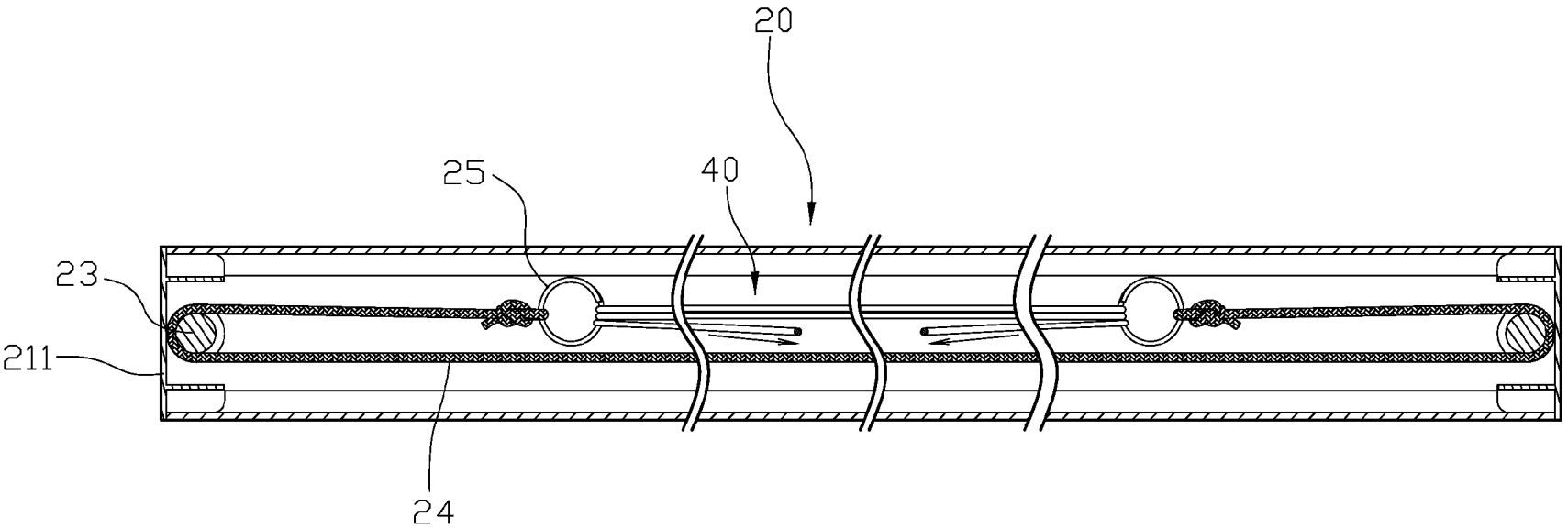
FIG. 4 illustrates a sectional view of the inner portion of the secondary rail in the present invention.
Figure 5:
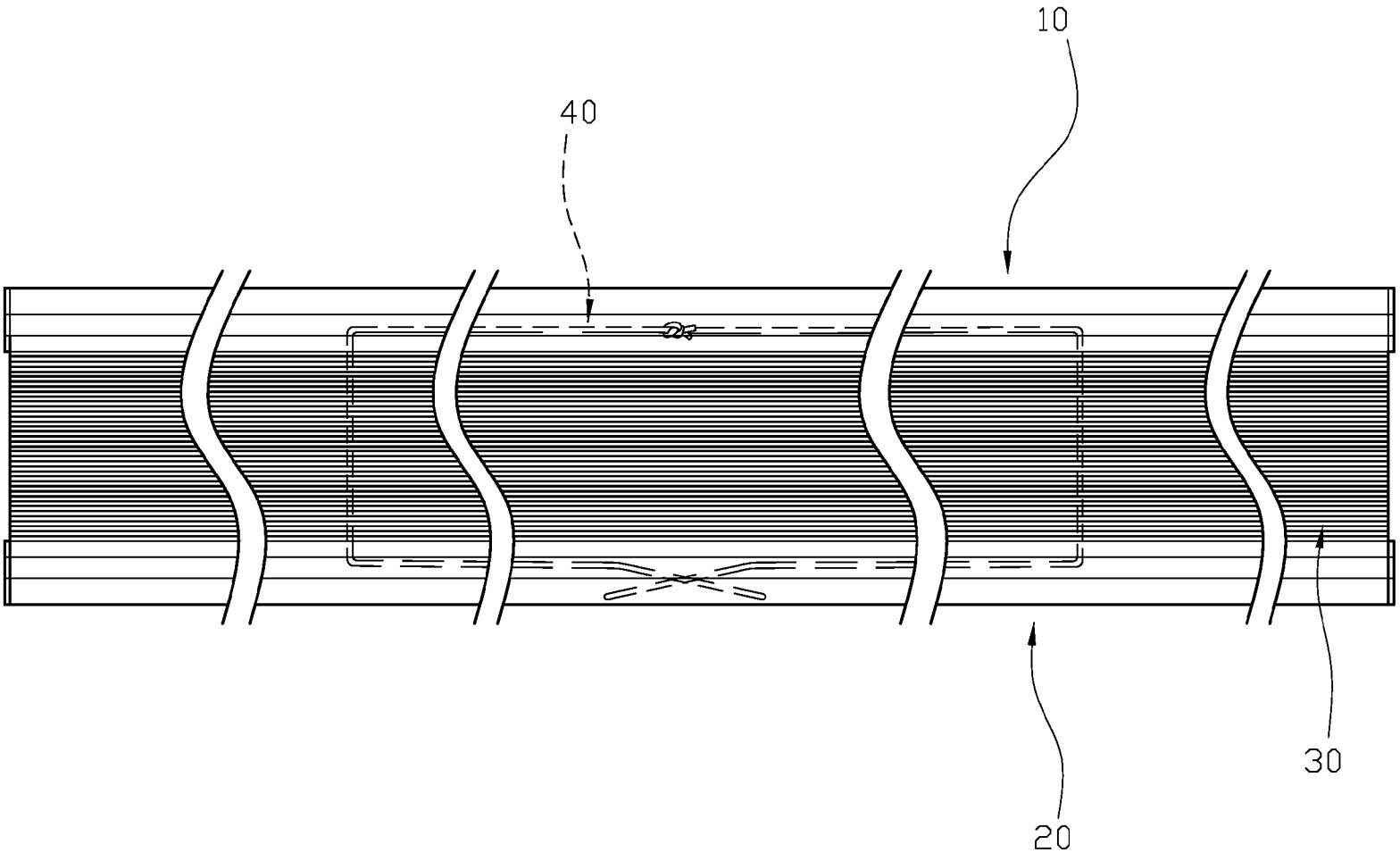
FIG. 5 illustrates a front view and disposition of the string body in the present invention.
Figure 6:
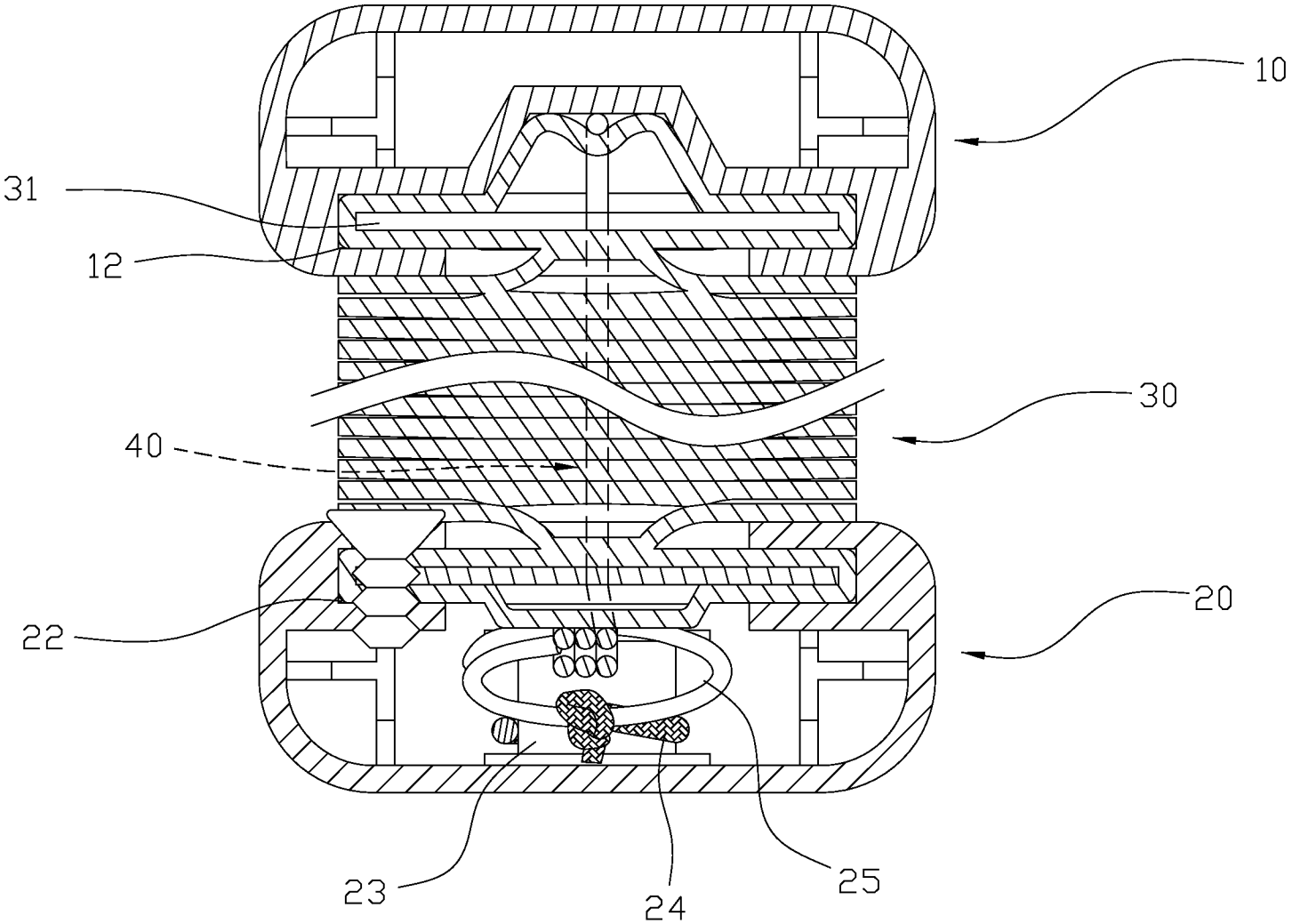
FIG. 6 illustrates a sectional view in the present invention.
Figure 7:
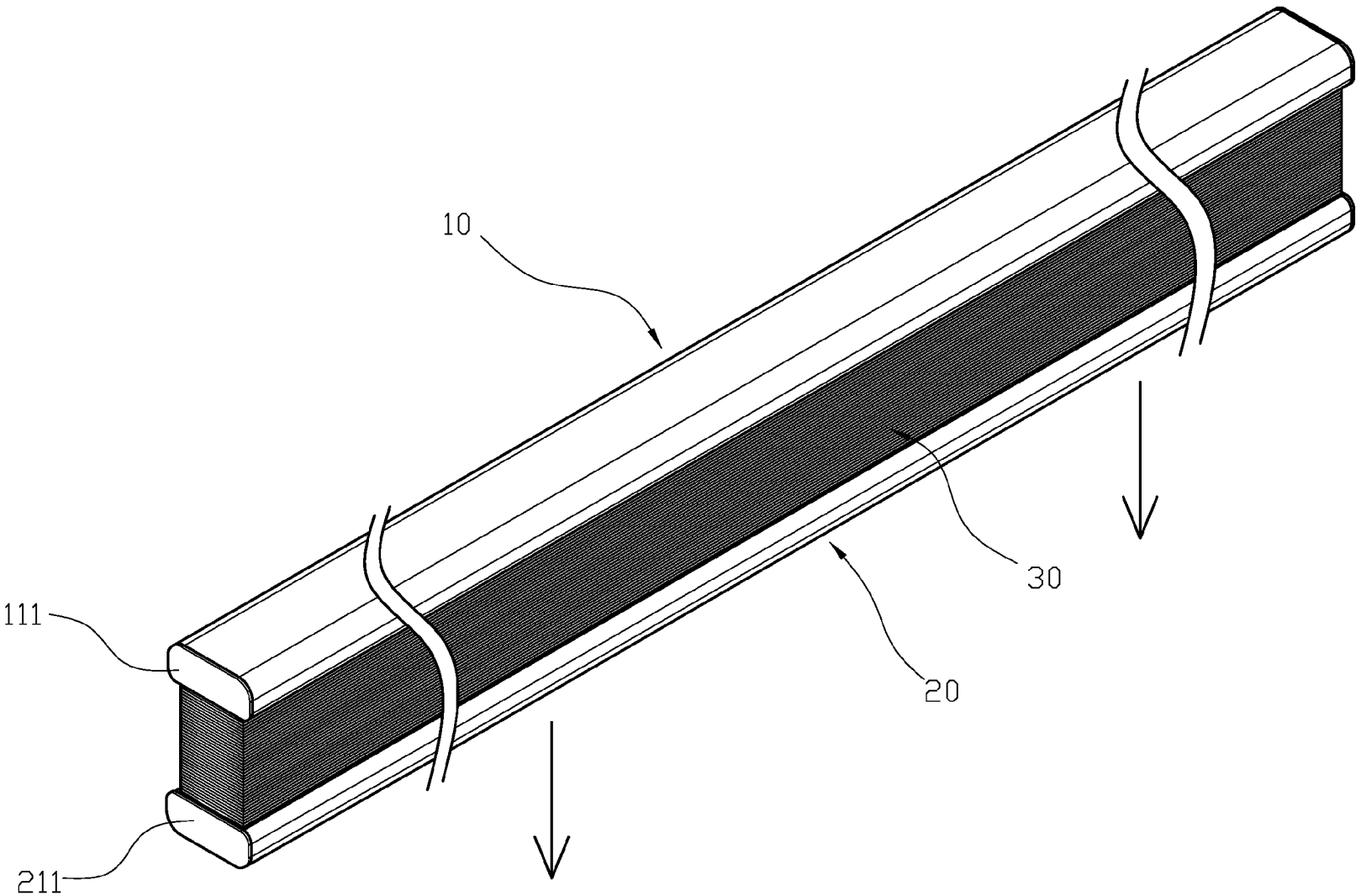
FIG. 7 illustrates a schematic view when the blind is in use in the present invention.
Figure 8:
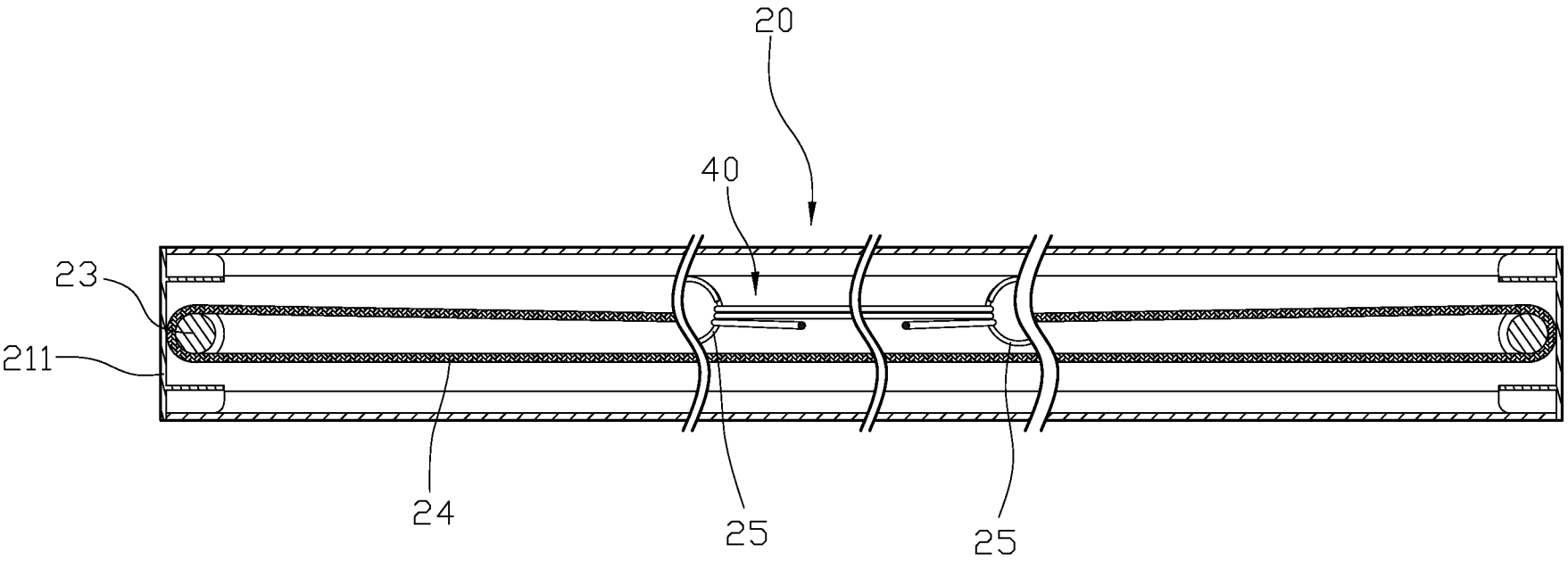
FIG. 8 illustrates a schematic view of the secondary rail when the blind expands in the present invention.
Figure 9:
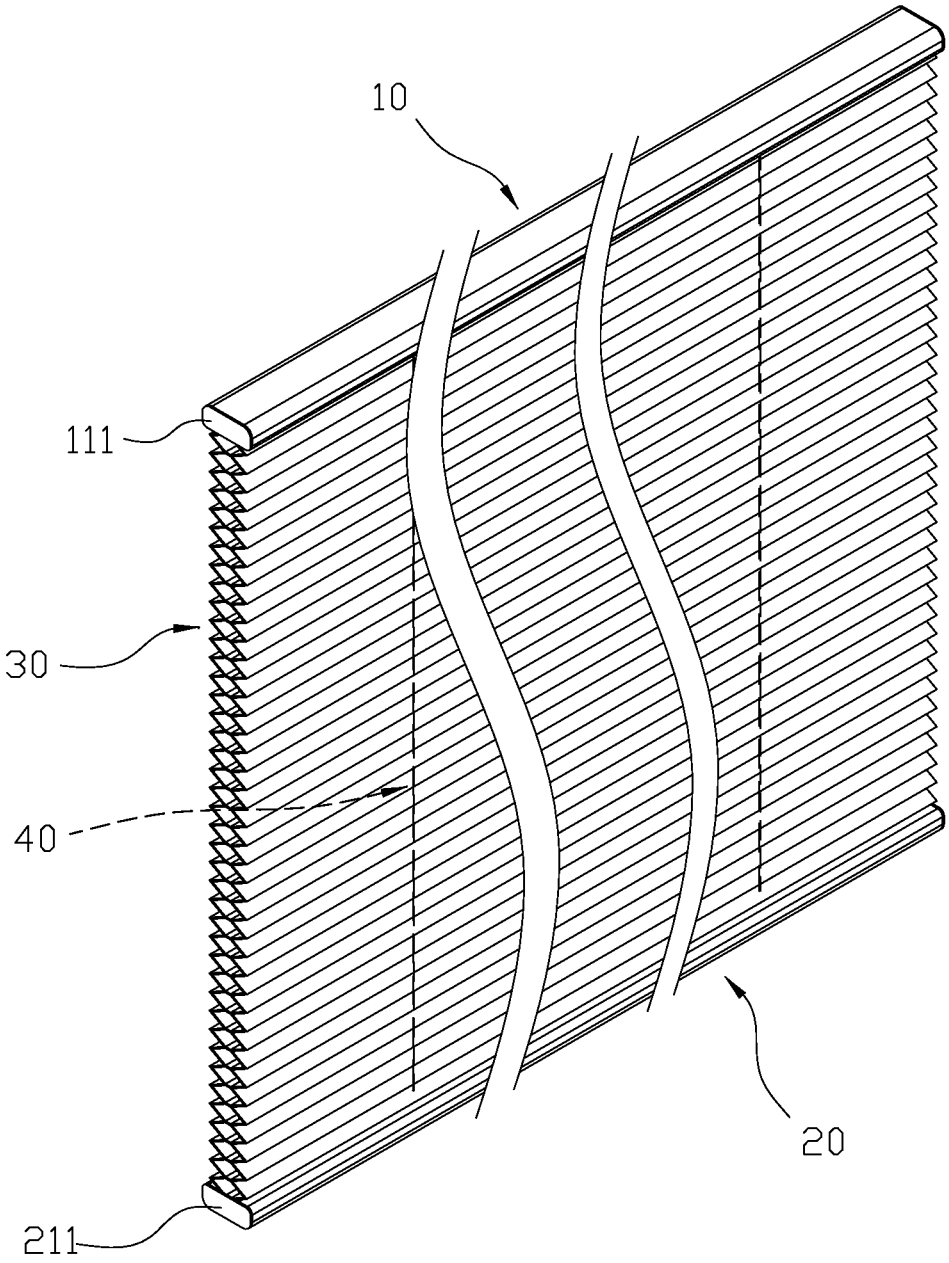
FIG. 9 illustrates a schematic view when the blind expands in the present invention.

In order to further understand the goal, characteristics and effect of the present invention, a number of embodiments along with the drawings are illustrated as following:

Referring to FIGS. 1 to 2, the present invention provides a stringless blind structure including a main rail (10), a secondary rail (20), a main blind body (30) and a string body (40). An open slot (11) is horizontally formed at one side of the main rail (10), and a sliding rail (12) is formed inside. A second open slot (21) is horizontally formed at one side of the secondary rail (20), and a second sliding rail (22) is formed inside. Inner space of the secondary rail (20) is divided into a left side and a right side, and a corresponding restricting portion (23) is formed therein. One end of a string (24) is disposed around the restricting portion (23), and a connecting unit (25) is coupled with the same end. Both sides of the open slot (11) and the second open slot (21) of the mail rail (10) and the second rail (20) have a cover (111) and a second cover (211) respectively, and a straight rod (212) can extend from a bottom surface of the second cover (211) of the second rail (20) to provide for the restricting portion (23) being disposed thereon and to form a secured positioning (see FIG. 3). The main blind body (30) engages with the main rail (10) and the secondary rail (20) through an upper end and a lower end, wherein a connecting board (31) is disposed at the upper and the lower ends of the main blind body (30) to insert into the sliding rail (12) and the second sliding rail (22) of the mail rail (10) and the secondary rail (20) to form a secured positioning. Also, two through holes (32) are formed through the upper portion to the lower portion of the main blind body (30). The string body (40) winds several times between two connecting units (25) and two ends thereof with identical length are cross, inserted into the through holes (32) of the main blind body (30) (see FIGS. 3 and 4), and tied at the upper portion of the main blind body (30) to form a secured positioning.

Referring to FIGS. 2, 4, 5 and 6, the inner portion of the secondary rail (20) provides the string (24) to wind around the restricting portion (23) with its two ends, each of which couples with the connecting unit (25). Middle portion of the string body (40) winds around the connecting units (25), and two ends thereof with identical length are cross, inserted into the through holes (32) of the main blind body (30), and tied at the upper portion of the main blind body (30). The connecting board (31) is disposed at both ends of the main blind body (30) and inserted into the sliding rail (12) and the second sliding rail (22) of the mail rail (10) and the secondary rail (20) to form a secured positioning. Also, the cover (11) and the second cover (211) are provided to cover both sides of the open slot (11) and the second open slot (21) of the main rail (10) and the secondary rail (20) to complete the stringless blind structure.

Referring to FIGS. 4, 7, 8 and 9, when the blinds are not used, the string body (40) is collected between two connecting units (25) through the string (24) to shorten the length between the string body (40) and the main blind body (30). When a user wants to expand the main blind body (30) to shield the sunlight, the main blind body (30) can be pulled down from the main rail (10) or the secondary rail (20) to expand the main blind body (30) and the string body (40) from the secondary rail (20) at the same time. Also, the string body (40) is connected with the string (24) through the connecting unit (25), and the string body (40) winds with the connecting unit (25), and are cross and inserted into the through hole (32) of the main blind body (30). When the string body (40) is pulled out with the main blind body (30), two connecting units (25) are moved towards the center, and the string (24) is stretched due to the movement of the connecting units (25). Meanwhile, the main rail (10) or the secondary rail (20) are securely positioned and expand due to the winding of the string body between the connecting unit (25) and the resilient force of the string (24).

On the other hand, when the main blind body (30) are restored to its original position, the main rail (10) or the secondary rail (20) are pushed up, and the string body (40) is loosened due to the reduction of the gravity of the main rail (10) and the secondary rail (20). Also, two connecting units (25) are moved toward outside due to the resilience of the string (24), so that the string body (40) are collected between two connecting units (25). And the string body (40) is restricted by the string (24) to prevent the string body (40) from being pulled out by the weight of the main rail (10) and the secondary rail (20), and to further prevent the main blind body (30) from expanding when there is no force applied to it.

According to the embodiments discussed above, the present invention is advantageous because the main rail (10), the secondary rail (20) and the main blind body (30) are connected and operated through the string body (40) and the string (24), so the cost of the structure is lower and the it is more convenient and easier to assemble. Also, the string body (40) winds around two connecting units (25), and is restricted by the string (24). When the main blind body (30) expands or restores through the movement of the main rail (10) and the secondary rail (20), the movement is restricted and controlled by the string (24) to achieve the goal of stringless movement to reduce the noise when the blind moves and to further improve the life quality at home.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A blind structure comprising:

a main rail, having an open slot horizontally formed at one side thereof and a first inner rail inside;

a secondary rail, having a second open slot horizontally formed at one side thereof and a second inner rail inside; inner space of the secondary rail divided into a left side and a right side, and a corresponding restricting portion formed on each side; and two ends of a string disposed around the restricting portions, and each end coupled with a respective connecting unit;

a main blind body, engaging with the main rail and the secondary rail through an upper end and a lower end, and two through holes formed through an upper portion to a lower portion of the main blind body; and a string body, winding several times between said two connecting units, wherein two ends thereof are inserted into the through holes of the main blind body, and tied at the upper portion of the main blind body to form a secured positioning, wherein when the string body is pulled out with the main blind body, said two connecting units are moved towards each other, and the string is stretched due to the movement of the connecting units, and the main rail or the secondary rail is capable of being securely positioned due to the winding of the string body between the connecting unit and a resilient force of the string, wherein when the main blind body is lifted to a compressed state, the main rail or the secondary rail is lifted, and the string body is loosened due to an upward force on the main rail or the secondary rail, and the two connecting units are moved away from each other due to the resilient force of the string, so that the string body are collected between the two connecting units.

2. The blind structure of claim 1, wherein a cover and a second cover is provided on each sides of the open slot and the second open slot respectively.

3. The blind structure of claim 2, wherein a straight rod extends from a bottom surface of the second cover of the secondary rail to provide for the restricting portion being disposed thereon and to form a secured positioning.

4. The blind structure of claim 1, wherein a connecting board is disposed at each of the upper and the lower ends of the main blind body to insert into the first inner rail and the second inner rail of the mail rail and the secondary rail to form a secured positioning.

* * * * *